US009052679B2

(12) United States Patent
Oka

(10) Patent No.: US 9,052,679 B2
(45) Date of Patent: Jun. 9, 2015

(54) CLEANING DEVICE, PROCESS CARTRIDGE, AND IMAGE FORMING APPARATUS

(71) Applicant: CANON KABUSHIKI KAISHA, Tokyo (JP)

(72) Inventor: Hideto Oka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/952,378

(22) Filed: Jul. 26, 2013

(65) Prior Publication Data

US 2014/0037323 A1 Feb. 6, 2014

(30) Foreign Application Priority Data

Jul. 31, 2012 (JP) ..... 2012-169833

(51) Int. Cl.
*G03G 21/00* (2006.01)

(52) U.S. Cl.
CPC ..... *G03G 21/0029* (2013.01); *G03G 21/007* (2013.01)

(58) Field of Classification Search
CPC ..... G03G 21/0029; G03G 21/007; G03G 21/1814
USPC ..... 399/102, 350, 351, 123
See application file for complete search history.

(56) References Cited

U.S. PATENT DOCUMENTS 5,470,635 A 11/1995 Shirai
5,608,509 A 3/1997 Shirai
5,828,928 A 10/1998 Sasago
6,137,973 A * 10/2000 Nishiuwatoko et al. ..... 399/111
6,459,866 B1 * 10/2002 Meguro ..... 399/350
2007/0019989 A1 * 1/2007 Nakamori ..... 399/159
2013/0071164 A1 * 3/2013 Sunahara ..... 399/350
2013/0216287 A1 * 8/2013 Inami ..... 399/351
2014/0153989 A1 * 6/2014 Shindo et al. ..... 399/351
2014/0153990 A1 * 6/2014 Oka et al. ..... 399/351

FOREIGN PATENT DOCUMENTS

JP 2002-341721 A 11/2002
JP 2007-193420 A 8/2007

* cited by examiner

*Primary Examiner* — Rodney Bonnette

(74) *Attorney, Agent, or Firm* — Canon USA Inc. IP Division

(57) ABSTRACT

A cleaning device includes a cleaning member having a flexible supporting member for supporting a blade portion having one end to place the blade portion, the other end having a portion to be fixed to the fixing portion, and a bent portion arranged between the one end and the other end, the bent portion being outwardly arranged away from the surface of an image bearing member, the supporting member in which the portion to be fixed, is arranged, with respect to the contact portion, at the downstream side in the movement direction of the image bearing member, and a container formed of a frame for containing a developer. Between the frame and the other end portion, a space allowing the other end portion to elastically deform is provided, and the container is provided with a sealing member configured to prevent intrusion of the developer into the space.

25 Claims, 18 Drawing Sheets

EXEMPLARY EMBODIMENT 1

COMPARATIVE EXAMPLE 1

EXEMPLARY EMBODIMENT 1

COMPARATIVE EXAMPLE 1

CLEANING DEVICE, PROCESS CARTRIDGE, AND IMAGE FORMING APPARATUS

BACKGROUND OF THE INVENTION

1. Field of the Invention

The present invention relates to a cleaning device for removing a developer from a surface of an image bearing member, a process cartridge, and an image forming apparatus.

The image forming apparatus includes, for example, electrophotographic copying machines, laser beam printers, light-emitting diode (LED) printers, and facsimile machines. The process cartridge refers to a cartridge including at least an image bearing member and a cleaning device integrally assembled and detachably attached to the image forming apparatus.

2. Description of the Related Art

A cleaning blade method is employed in the electrophotographic image forming apparatus as a cleaning means for removing, in order to repetitively use an image bearing member, a developer remaining on the image bearing member after transferring a developer image from the image bearing member to a recording medium. In the cleaning blade method, a blade having elasticity is pressed to come in contact with the surface of the image bearing member at a predetermined pressure to remove the developer from the surface of the image bearing member.

Japanese Patent Application Laid-Open No. 2002-341721 discusses a structure in which a blade is attached by molding to an end portion of a metal plate serving as a supporting member. The metal plate is attached to a frame with a screw or the like to fix the cleaning member, so that the cleaning member comes in contact with the surface of an image bearing member at a predetermined pressure.

SUMMARY OF THE INVENTION

However, the image forming apparatuses such as printers tend to be downsized, have a large increase in speed, and obtain an improvement in image quality as they become prevalent. The downsizing of the image forming apparatuses reduces the sizes of the image bearing members. Further, the increase in speed enhances the rotation speed of the image bearing members. This means that the blade contacting the surface of the image bearing member repetitively slides on the surface of the image bearing member at high speed. This causes temperature increase of the blade, and thereby the hardness of the blade is decreased. As a result, the friction force between the image bearing member surface and the blade increases. This may cause increase in driving torque for driving the image bearing member and curling of the blade. Further, these days, some image forming apparatuses employ spherical developer to increase image quality. In such a case, in order to remove the developer from the image bearing member surface, the contact pressure of the blade on the image bearing member is to be increased, and this becomes one factor for worsening the above-mentioned problems.

SUMMARY OF THE INVENTION

The present invention is directed to providing a cleaning device, a process cartridge, and an image forming apparatus capable of reducing increase in driving torque for driving an image bearing member and reducing curling of a blade.

According to an aspect of the present invention, a cleaning device to be used in an image forming apparatus is provided.

The cleaning device includes a cleaning member configured to remove a developer from an image bearing member, the cleaning member being attached to a fixing portion provided in a frame, the cleaning member including a blade portion contacting the image bearing member in a counter direction with respect to a moving direction of the image bearing member, a flexible supporting member configured to support the blade portion including one end portion in which the blade portion is provided, the other end portion having a portion to be fixed to the fixing portion, and a bent portion arranged between the one end portion and the other end portion, the bent portion being arranged outward, with respect to the line segment connecting a contact portion where the blade contacts the image bearing member, with the portion to be fixed, away from the surface of the image bearing member, including the supporting member, where the portion to be fixed, is arranged, with respect to the contact portion, at the downstream side in the movement direction of the image bearing member, and a container configured to store the developer removed from the image bearing member, the container being formed of the frame. Between the frame and the other end portion, a space allowing the other end portion to elastically deform is provided, and the container is provided with a sealing member configured to prevent intrusion of the developer into the space.

According to another aspect of the present invention, a cleaning device to be used in an image forming apparatus is provided. The cleaning device includes a cleaning member configured to remove a developer from an image bearing member, the cleaning member being attached to a fixing portion provided in a frame, the cleaning member including a blade portion contacting the image bearing member in a counter direction with respect to a moving direction of the image bearing member, a flexible supporting member configured to support the blade portion, the flexible supporting member having a curved shape for supporting the blade portion, including a blade portion supporting portion in which the blade portion is provided at a tip side, a portion to be fixed to the fixing portion, and a curving peak arranged between the blade portion supporting portion and the portion to be fixed, the curving peak being arranged outward, with respect to the line segment connecting a contact portion where the blade portion contacts the image bearing member and the portion to be fixed, away from the surface of the image bearing member, including the supporting member where the portion to be fixed, is arranged, with respect to the contact portion, at the downstream side in the movement direction of the image bearing member, and a container configured to store the developer removed from the image bearing member, the container being formed of the frame. Between a portion from the bent portion to the portion to be fixed, and the frame, a space allowing the portion to elastically deform is provided, and the container is provided with a sealing member configured to prevent intrusion of the developer into the space.

According to yet another aspect of the present invention, an image forming apparatus configured to form an image on a recording medium is provided. The image forming apparatus includes (i) an image bearing member, and (ii) a cleaning device including a cleaning member configured to remove a developer from the image bearing member, the cleaning member being attached to a fixing portion provided in a frame, the cleaning member including a blade portion contacting the image bearing member in the counter direction with respect to a moving direction of the image bearing member, and a flexible supporting member configured to support the blade portion including one end portion in which the blade portion is provided, the other end portion having a portion to be fixed to the fixing portion, and a bent portion arranged between the one end portion and the other end portion, the bent portion being arranged outward, with respect to the line segment connecting a contact portion where the blade contacts the image bearing member, with the portion to be fixed, away from the surface of the image bearing member, including the supporting member where the portion to be fixed, is arranged, with respect to the contact portion, at the downstream side in the movement direction of the image bearing member, and a container configured to store the developer removed from the image bearing member, the container being formed of the frame. Between the frame and the other end portion, a space allowing the other end portion to elastically deform is provided, and the container is provided with a sealing member configured to prevent intrusion of the developer into the space.

According to yet another aspect of the present invention, a process cartridge detachably moutable to an apparatus body of an image forming apparatus is provided. The process cartridge includes (i) an image bearing member, and (ii) a cleaning device including a cleaning member configured to remove a developer from the image bearing member, the cleaning member being attached to a fixing portion provided in a frame, the cleaning member including a blade portion contacting the image bearing member in a counter direction with respect to a moving direction of the image bearing member, and a flexible supporting member configured to support the blade portion including one end portion in which the blade portion is provided, the other end portion having a portion to be fixed to the fixing portion, and a bent portion arranged between the one end portion and the other end portion, the bent portion being arranged outward, with respect to the line segment connecting a contact portion where the blade contacts the image bearing member, with the portion to be fixed, away from the surface of the image bearing member, including the supporting member where the portion to be fixed, is arranged with respect to the contact portion, at the downstream side in the movement direction of the image bearing member, and a container configured to store the developer removed from the image bearing member, the container being formed of the frame. Between the frame and the other end portion, a space allowing the other end portion to elastically deform is provided, and the container is provided with a sealing member configured to prevent intrusion of the developer into the space.

According to yet another aspect of the present invention, a process cartridge detachably moutable to an apparatus body of an image forming apparatus is provided. The process cartridge includes (i) an image bearing member, and (ii) a cleaning device including a cleaning member configured to remove a developer from the image bearing member, the cleaning member being attached to a fixing portion provided in a frame, the cleaning member including a blade portion contacting the image bearing member in a counter direction with respect to a moving direction of the image bearing member, a flexible supporting member configured to support the blade portion, the flexible supporting member having a curved shape for supporting the blade portion, including a blade portion supporting portion in which the blade portion is provided at a tip side, a portion to be fixed to the fixing portion, and a curving peak arranged between the blade portion supporting portion and the portion to be fixed, the curving peak being arranged outward, with respect to the line segment connecting a contact portion where the blade portion contacts the image bearing member and the portion to be fixed, away from the surface of the image bearing member, including the supporting member where the portion to be fixed, is arranged, with respect to the contact portion, at the downstream side in the movement direction of the image bearing member, and a container configured to store the developer removed from the image bearing member, the container being formed of the frame. Between a portion from the bent portion to the portion to be fixed, and the frame, a space allowing the portion to elastically deform is provided, and the container is provided with a sealing member configured to prevent intrusion of the developer into the space.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 14:
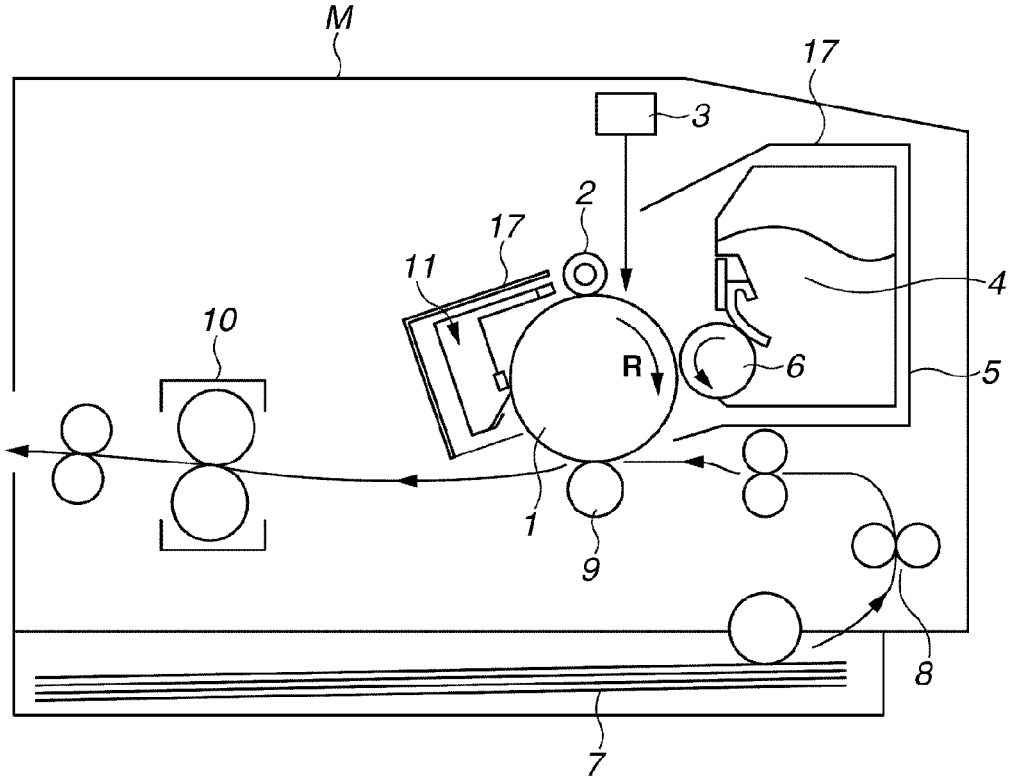
FIG. 14 illustrates an image forming apparatus according to the exemplary embodiment.

One example of an image forming apparatus according to the exemplary embodiment will be described. The image forming apparatus illustrated in FIG. 14 is a monochromatic laser beam printer of an electrophotographic type, and FIG. 14 is a schematic view of the image forming apparatus.

At a substantially central portion of an image forming apparatus body M, a drum-type photosensitive drum 1 serving as an image bearing member (member to be charged) is provided. In the photosensitive drum 1, an organic photoconductor (OPC) (optical semiconductor) photosensitive layer is formed on an outer peripheral surface of a conductive drum base of aluminum or the like. The photosensitive drum 1 is driven and rotated in an arrow R direction at a predetermined process speed of 200 mm/s.

The surface (peripheral surface) of the photosensitive drum 1 is uniformly charged to a predetermined polarity and a predetermined potential by a charging roller 2 serving as a charging member. The surface of the charged photosensitive drum 1 is subjected to scanning exposure to a laser beam output from a laser beam scanner 3 serving as an exposure means. The laser beam is modulated corresponding to a time-series electric digital pixel signal of target image information. Thus, an electrostatic latent image corresponding to the target image information is formed. Toner (developer) 4 conveyed by a developing sleeve 6 of a developing device 5 adheres to the electrostatic latent image, so that the latent image is developed as a toner image.

A recording medium 7 is fed by a sheet feeding roller 8 and is sent to a transfer nip portion between the photosensitive drum 1 and a transfer roller 9 in synchronization with the toner image written on the photosensitive drum 1, so that the toner image is transferred on the surface of the recording medium 7. During the transferring operation, a transfer bias is applied to the transfer roller 9 from a transfer bias applying power source (not illustrated). The recording medium 7 on which the toner image has been transferred is separated from the surface of the photosensitive drum 1, and conveyed to a fixing device 10 serving as a fixing unit. In the fixing device 10, the recording medium 7 is heated and pressed to fix the toner image on the surface.

The photosensitive drum 1 after the toner image transfer is subjected to cleaning. The residual toner remaining on the surface without being transferred onto the recording medium 7 is removed by a cleaning device 11 serving as a cleaning means, and used for next image formation.

Figure 15:
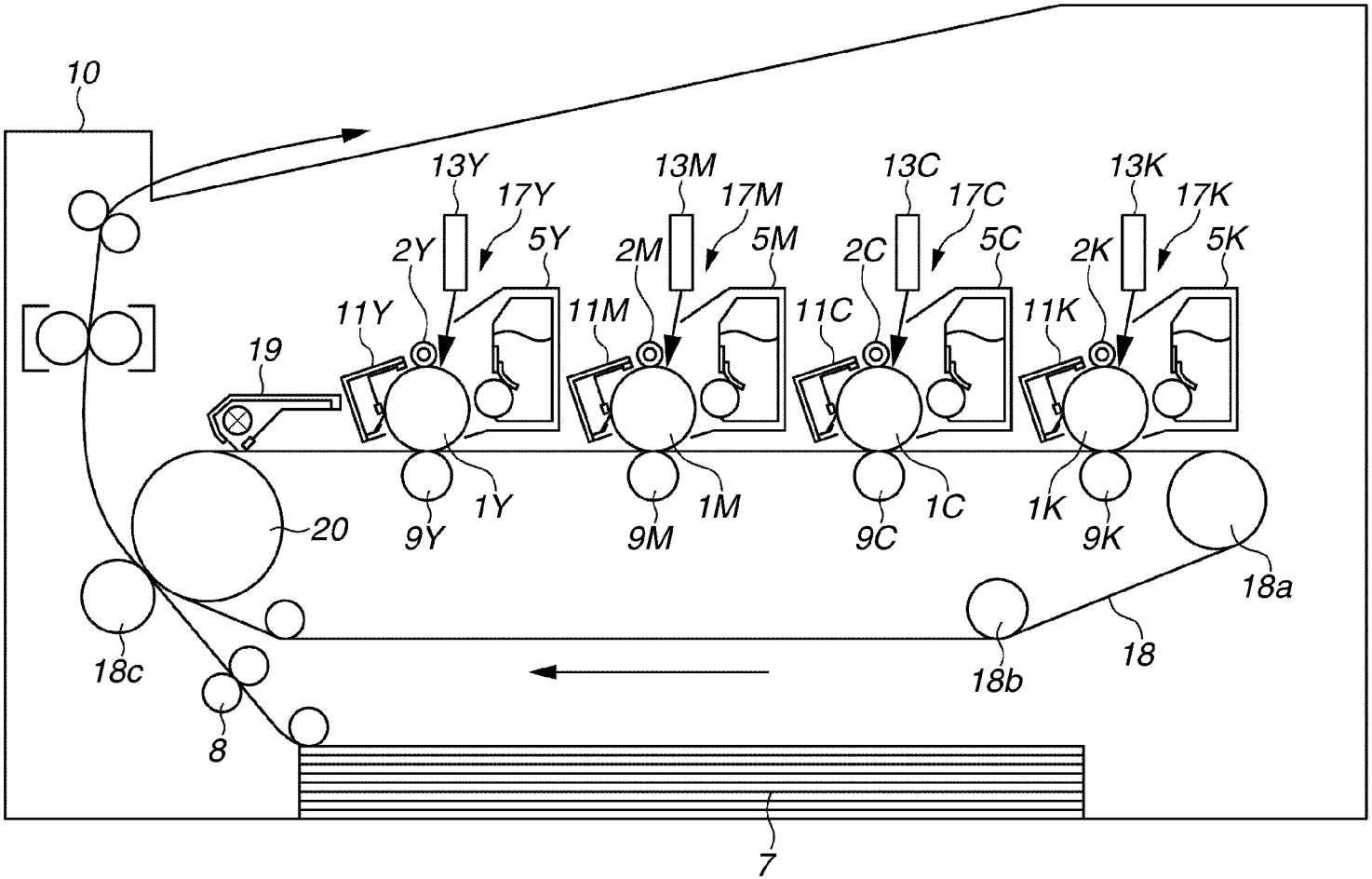
FIG. 15 illustrates an image forming apparatus of a color-tandem type according to the exemplary embodiment.

This exemplary embodiment can also be applied to cleaning of a color image forming apparatus. FIG. 15 illustrates a structure of an image forming apparatus of a color-tandem type. The image forming apparatus is a color laser printer employing a transfer-type electrophotographic process, a contact charging method, and a reverse development method, and a maximum sheet passing size is the A3 size. The color image forming apparatus is a 4-drum type (in-line) printer having a plurality of process cartridges 17. In the color image forming apparatus, color toner images are once sequentially transferred onto an intermediate transfer belt 18 serving as a second image bearing member to obtain a superimposed full-color print image.

In FIG. 15, the endless intermediate transfer belt 18 is stretched by a driving roller 18*a*, a tension roller 18*b*, and a secondary transfer counter roller 18*c*. The belt 18 is driven and rotated in the arrow direction indicated in the drawing at a predetermined process speed of 300 mm/s. The four process cartridges 17 are disposed in line on the intermediate transfer belt 18 in the order of yellow 17Y, magenta 17M, cyan 17C, and black 17K.

In the image forming apparatus of the color tandem type, four cleaning devices (11Y, 11M, 11C, and 11K) are provided, and therefore a driving torque generated during drive of image bearing members (1Y, 1M, 1C, and 1K) is large. The driving torque can be effectively reduced by applying the present exemplary embodiment.

As illustrated in FIG. 15, the present exemplary embodiment can be applied to an intermediate transfer belt cleaner 19 for removing the toner 4 remaining on the intermediate transfer belt 18 after passing a secondary transfer roller 20. In the present exemplary embodiment, the toner 4 collected in the intermediate transfer belt cleaner 19 is conveyed to a waste toner collection container (not illustrated) by a screw.

Figure 16:
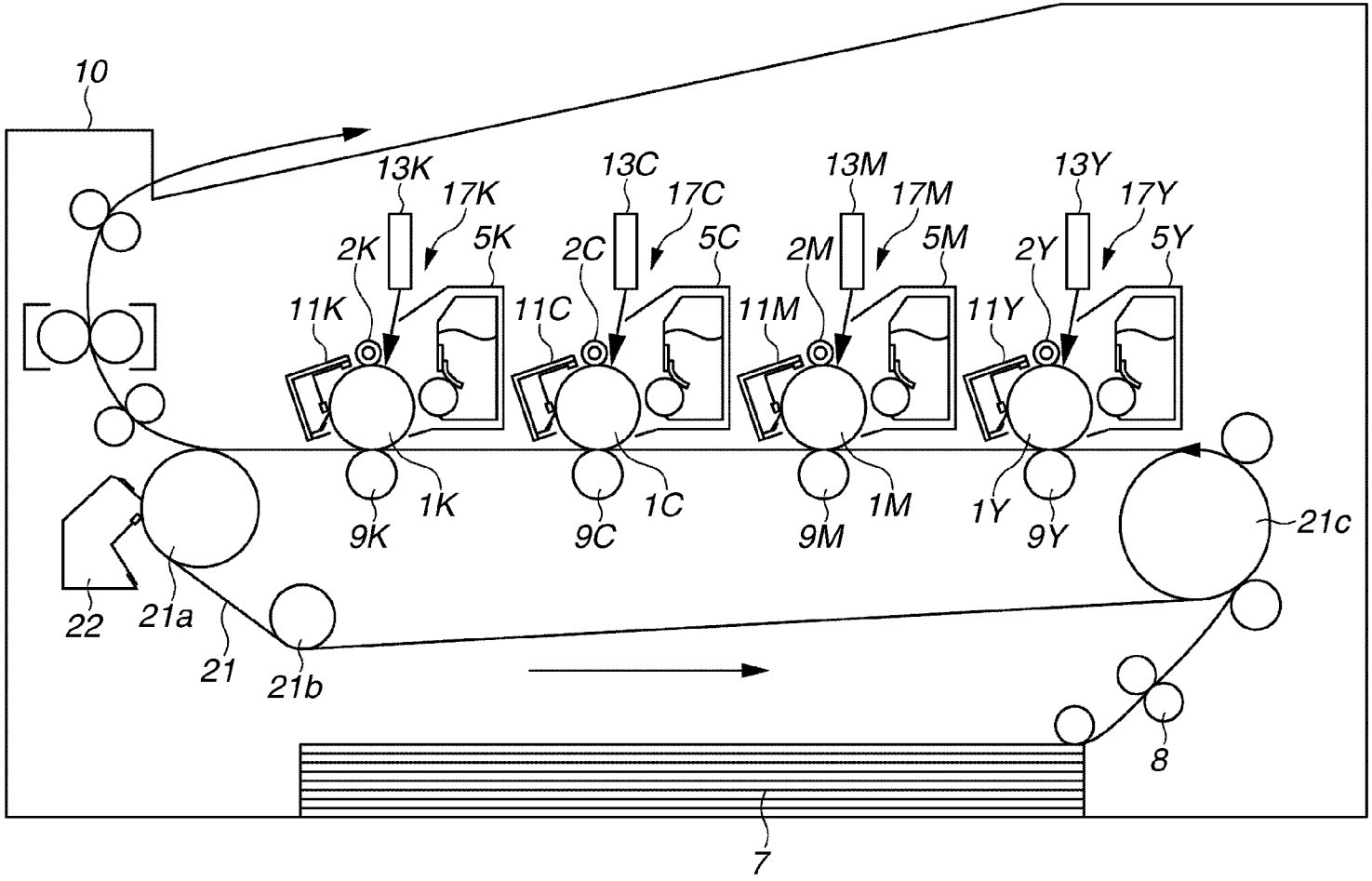
FIG. 16 illustrates an image forming apparatus having a recording material conveying member according to the exemplary embodiment.

The present exemplary embodiment is also applicable to a cleaning device for a transfer and conveyance belt 21 for conveying the recording medium 7 to transfer a toner image borne by the photosensitive drum 1. FIG. 16 illustrates an image forming apparatus of a color-tandem type having the transfer and conveyance belt 21. In FIG. 16, the endless transfer and conveyance belt 21 is stretched by a driving roller 21*a*, a tension roller 21*b*, and a driven roller 21*c*. The belt 21 is driven and rotated in the arrow direction indicated in the drawing at a predetermined process speed of 300 mm/s. The four process cartridges 17 are disposed in line on the transfer and conveyance belt 21 in the order of yellow 17Y, magenta 17M, cyan 17C, and black 17K. The recording medium 7 is conveyed by the transfer and conveyance belt 21 and onto which toner images formed on the photosensitive drums (1Y, 1M, 1C, and 1K) are sequentially transferred by transfer rollers (9Y, 9M, 9C, and 9K). On the photosensitive drums (1Y, 1M, 1C, and 1K), a fog toner exists, and between adjacent recording medium 7, the surface of the transfer and conveyance belt 21 is contaminated with the fog toner. The fog toner is collected by a transfer and conveyance belt cleaner 21.

Figure 2:
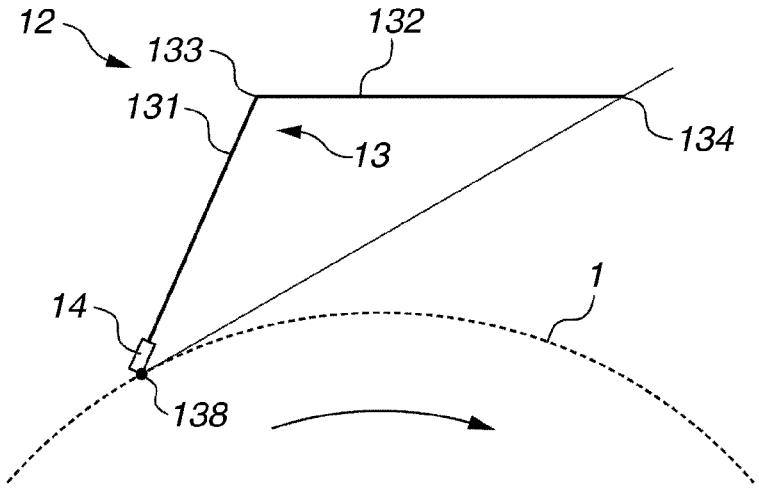
FIG. 2 is a schematic structural view illustrating a cleaning member according to the exemplary embodiment.

A cleaning member 12 according to the exemplary embodiment is described. FIG. 2 is a schematic structural view illustrating the cleaning member 12 according to the exemplary embodiment. The cleaning member 12 is attached to a fixing portion, and removes the toner 4 remaining after the transfer from the photosensitive drum 1 that is a cleaning target, has been performed. The cleaning member 12 includes a blade 14 that contacts the photosensitive drum 1 in a counter direction to the movement direction (the arrow direction in FIG. 2) of the photosensitive drum 1, and a flexible supporting member 13 for supporting the blade 14. The supporting member 13 includes an end portion 131 where the blade 14 is provided, another end portion 132 having a portion 134 to be fixed to the fixing portion, and a bent portion 133 arranged between the end portion 131 and another end portion 132. The bent portion 133 is arranged outward, with respect to a line segment L connecting a contact portion 138 where the blade 14 contacts the photosensitive drum 1 with the portion 134 to be fixed, away from the surface of the photosensitive drum 1 (at a side where the bent portion 133 is away from the surface of the photosensitive drum 1). The portion 134 to be fixed of the supporting member 13 is arranged downstream from the contact portion 138 in the movement direction of the photosensitive drum 1, and the blade 14 is supported only by the end portion 131.

The above arrangement of the cleaning member 12 can prevent rapid increase in the contact pressure of the blade even if the friction force between the photosensitive drum 1 and the blade 14 increases. Hereinafter, an action in the arrangement is described.

Figure 17:
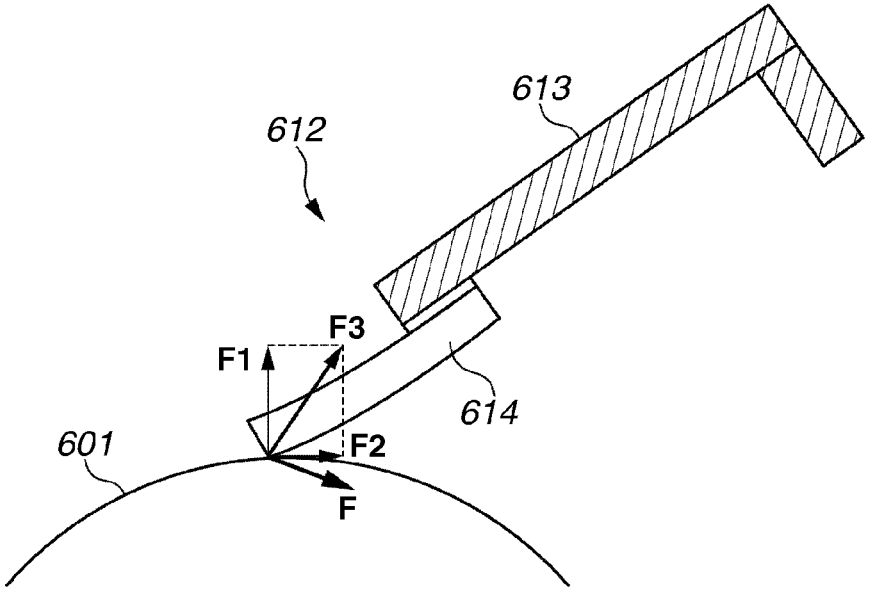
FIG. 17 is a detailed schematic structural view illustrating a cleaning member according to a comparative example.
Figure 18:
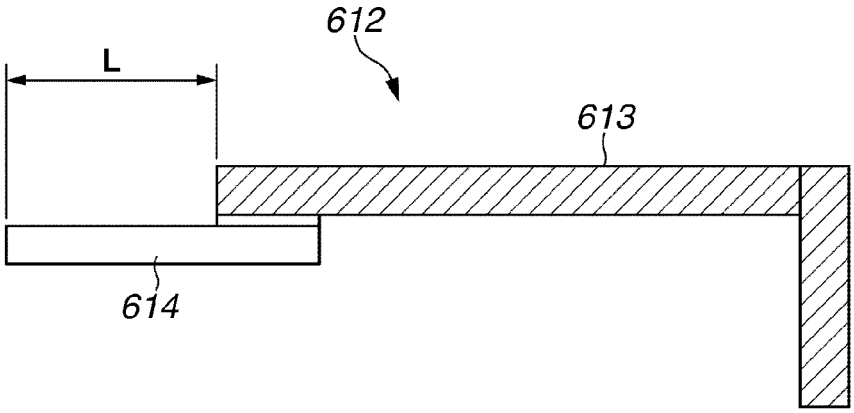
FIG. 18 is a detailed schematic structural view illustrating the cleaning member according to the comparative example.

First, a cleaning member 612 is described as a comparative example. FIG. 17 and FIG. 18 are schematic structural views illustrating a known cleaning member. A urethane rubber blade 614 which is an elastic member is supported by a supporting member 613 having stiffness and in contact with a photosensitive drum 601. The elastic blade 614 is pressed against (deformed on) the surface of the photosensitive drum 601 to obtain a contact pressure for removing a residual toner 604 from the surface of the photosensitive drum 601.

When the photosensitive drum 601 is rotated, the blade 614 receives a force F3 which is a resultant of a reaction force F1 due to the contact pressure of the blade 614 and a friction force F2 between the surface of the photosensitive drum 601 and the blade 614. The increase in the friction force F2 increases the resultant force F3. The blade 614 has a relatively small degree of freedom in the resultant force F3 direction. Consequently, the blade 614 is deformed in the arrow F direction in FIG. 17. The deformation direction is a direction the blade 614 digs into the photosensitive drum 601, and as a result, the reaction force F1 becomes large. The increase in the reaction force F1 further increases the friction force F2. As a result, the reaction force F1 rapidly increases. This may cause increase in driving torque for driving the photosensitive drum 601 and curling of the blade.

Figure 3:
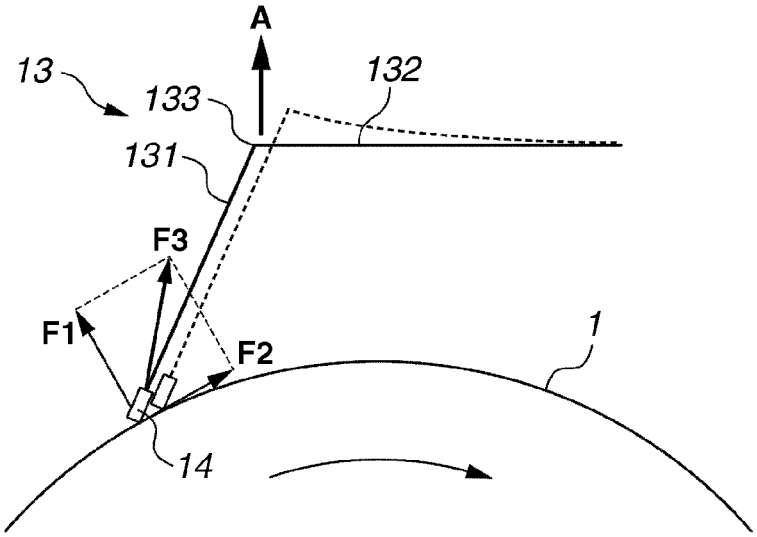
FIG. 3 is a conceptual view illustrating deformation of a supporting member according to the exemplary embodiment.

The cleaning member 12 according to the exemplary embodiment is described. FIG. 3 is a conceptual view illustrating the deformation of the flexible supporting member 13 when the friction force increases between the surface of the photosensitive drum 1 and the blade 14.

In the cleaning member 12 according to the exemplary embodiment of the present invention, the flexible supporting member 13 is pressed against (deformed on) the surface of the photosensitive drum 1 to obtain a contact pressure for removing the residual toner 4 from the surface of the photosensitive drum 1.

When the photosensitive drum 1 is rotated, the blade 14 receives the resultant force F3 which is the resultant of the reaction force F1 due to the contact pressure of the supporting member 13 and the friction force F2 between the surface of the photosensitive drum 1 and the blade 14. With respect to the resultant force F3, the end portion 131 has only a small angle formed between the end portion 131 and the resultant force F3, and therefore, a degree of freedom is very low as to deformation, so that the end portion 131 is hard to deform (i.e., the end portion 131 resists bending). On the other hand, with respect to a direction of the resultant force F3, another end portion 132 has a larger angle formed between another end portion 132 and the resultant force F3, and therefore, the degree of freedom is high as to deformation. Consequently, the end portion 132 can be deformed as indicated by the broken line in FIG. 3. Since the end portion 132 can be deformed in the arrow A direction in FIG. 3, the blade 14 is prevented from digging into the photosensitive drum 1 supported by the supporting member 13. As a result, the increase in the reaction force F1 can be suppressed. Consequently, the increase in driving torque for driving the photosensitive drum 1 and curling of the blade can be suppressed.

It is preferable that the end portion 132 has a structure to receive a strong bending moment caused by the resultant force F3. For this reason, it is preferable that the end portion 131 has a structure to receive a force from the blade 14 to elastically deform the end portion 132.

Further, it is important to form the end portion 132 to be elastically bent in the arrow A direction in FIG. 3 by the resultant force F3. Consequently, it is preferable that the blade 14 is supported only by the end portion 131 and does not extend to the bent portion 133 so that the elastic deformation (bending) of the end portion 132 is not prevented.

Figure 4:
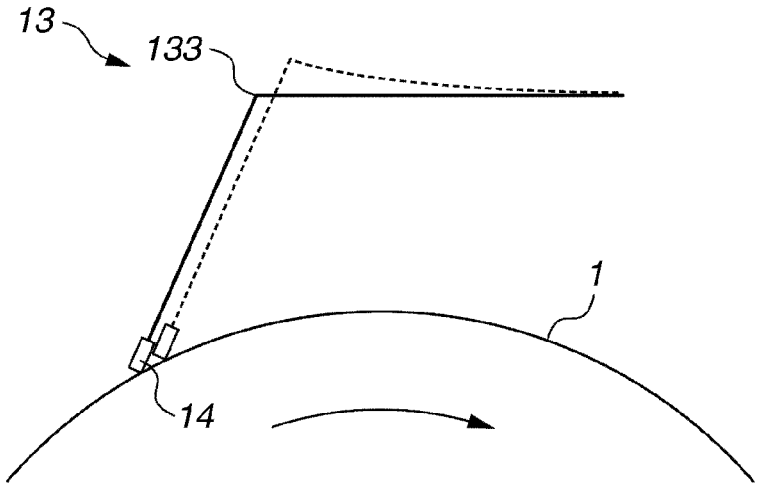
FIG. 4 is a conceptual view illustrating the deformation of the supporting member when a photosensitive drum is moved from a rest state.

FIG. 4 is a conceptual view illustrating the deformation of the supporting member 13 when the photosensitive drum 1 is moved from a rest state. It is preferable that the further digging of the blade 14 supported by the supporting member 13 toward the photosensitive drum 1 is suppressed. To achieve this, when the photosensitive drum 1 moves from the rest state, it is preferable that the bent portion 133 has a structure movable in a direction separating from the surface of the photosensitive drum 1.

As a material for the supporting member 13, an engineering plastic such as polyacetal (POM), polycarbonate (PC), and polyphenylene sulfide (PPS) can be employed. The supporting member 13 obtains a desired cleaning contact pressure by adjusting the thickness of the plate, the lengths of the end portion 131 and the end portion 132, and an amount of intrusion of the cleaning member 12 into the photosensitive drum 1.

As a material for the supporting member 13, for example, a metal spring member having a spring property such as SUS or phosphor bronze plate can also be employed. As compared to the above-mentioned engineering plastics, the metal material is advantageous in terms of productivity, cost, accuracy and the like. Alternatively, a damping member having elasticity can be employed.

Hereinafter, the cleaning device 11 will be described. The cleaning device 11 includes a cleaning container 15 serving as a container formed of a frame, for storing the toner 4 removed from the photosensitive drum 1, a fixing portion 153 provided in the cleaning container 15, and the cleaning member 12.

Figure 1:
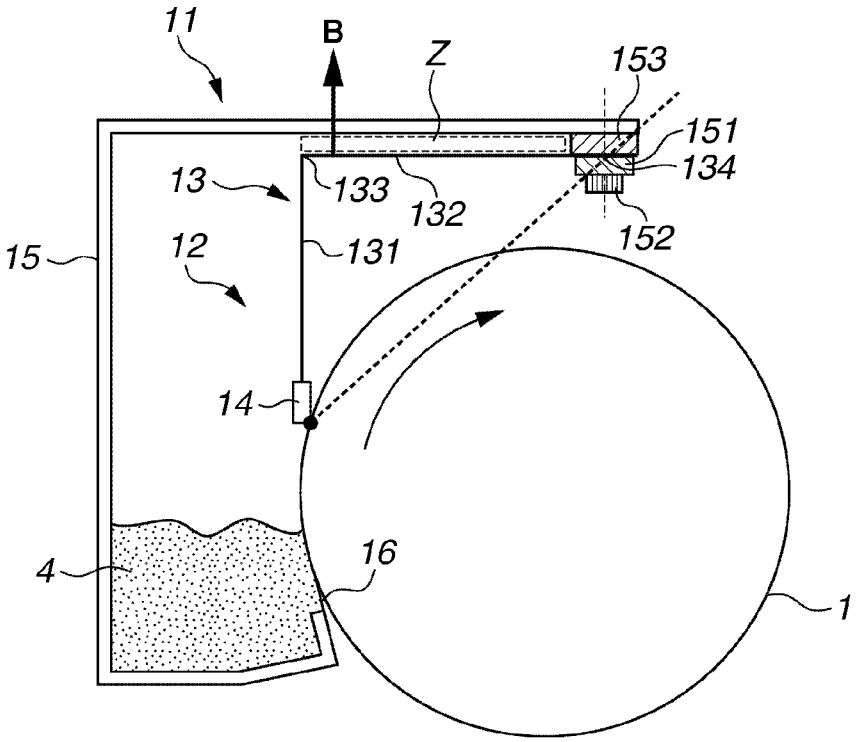
FIG. 1 is a schematic structural view illustrating a cleaning device according to the exemplary embodiment.

FIG. 1 is a schematic structural view illustrating the cleaning device 11 according to the exemplary embodiment. The cleaning device 11 includes the cleaning member 12, a scooping sheet 16, and the cleaning container 15. The cleaning member 12 contacts the surface of the photosensitive drum 1, and is used to scrape off the residual toner 4 remaining on the photosensitive drum 1 after the transfer. The scooping sheet 16 is provided at the upstream side in the rotation direction of the photosensitive drum 1 to scoop the scraped toner 4, and contacts the surface of the photosensitive drum 1. The cleaning container 15 stores the scooped residual toner 4. The cleaning member 12 is attached, at the portion 134 to be fixed, of the supporting member 13, to a fixing portion 153 provided in the cleaning container 15. As illustrated in FIG. 1, as an example of a fixing method of the cleaning member 12 to the cleaning container 15, the cleaning member 12 is fixed via a holding member 151 with fixing screws 152 provided at several positions in a longitudinal direction.

The portion from the bent portion 133 to the portion 134 to be fixed, of the supporting member 13 is arranged to face the inner wall of the cleaning container 15. When the photosensitive drum 1 is attached and when the photosensitive drum 1 is rotated, the portion from the bent portion 133 to the portion 134 to be fixed, of the flexible supporting member 13 elastically deforms in the B direction in FIG. 1. Especially, the supporting member 13 largely deforms around the bent portion 133. In such a case, if the portion from the bent portion 133 to the portion 134 to be fixed interferes with the inner wall of the cleaning container 15, the effects of the exemplary embodiment are not obtained. To solve the problem, between the portion from the bent portion 133 to the portion 134 to be fixed, and the inner wall of the cleaning container 15, as illustrated in FIG. 1, a space Z is provided. The space Z is set to a distance of a deformation amount or more to allow the elastic deformation in the portion from the bent portion 133 to the portion 134 to be fixed. In the present exemplary embodiment, the space Z is set to 3 mm.

Next, the process cartridge 17 detachably mountable to the image forming apparatus body M will be described. The process cartridge 17 includes the photosensitive drum 1, the fixing portion 153 provided in the cleaning container 15, and the cleaning member 12 according to the exemplary embodiment present invention.

Figure 5:
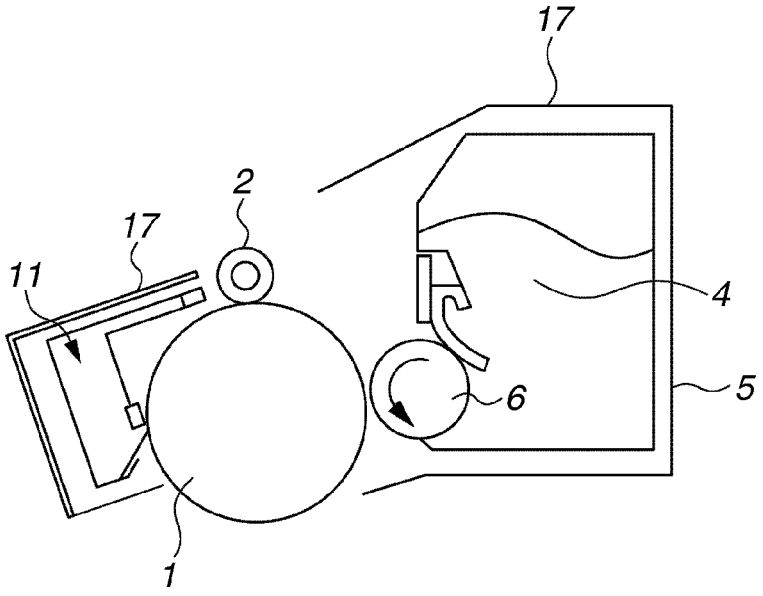
FIG. 5 is a schematic structural view illustrating a process cartridge according to the exemplary embodiment.

FIG. 5 is a schematic structural view illustrating the process cartridge 17 according to the exemplary embodiment. In the process cartridge 17, four process devices, namely the photosensitive drum 1, the charging roller 2, the developing device 5 and the cleaning device 11, are integrally assembled into a cartridge container. The process cartridge 17 is detachably mounted to the image forming apparatus body M.

Figure 6:
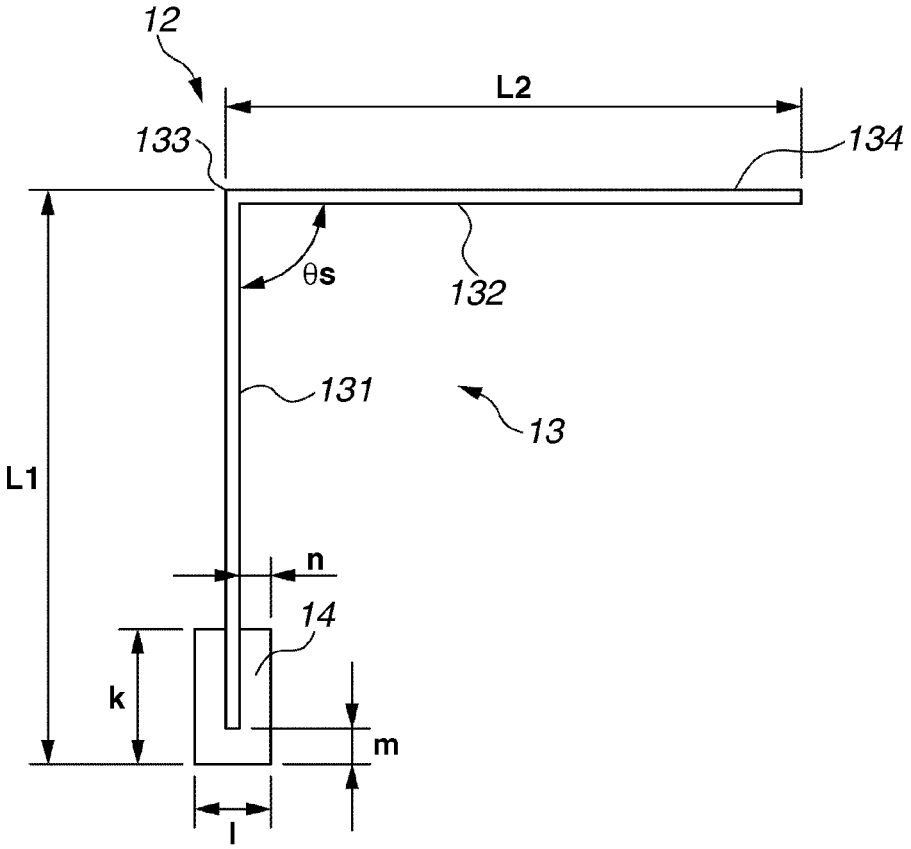
FIG. 6 is a detailed schematic structural view illustrating the cleaning member according to the exemplary embodiment.

The cleaning member 12 will be described more specifically. FIG. 6 is a detailed schematic structural view illustrating the cleaning member 12 according to the exemplary embodiment.

As described above, the cleaning member 12 includes the flexible supporting member 13 and the blade 14. The supporting member 13 includes an end portion 131, another end portion 132, and a bent portion 133. In the end portion 131, the blade 14 is. Another end portion 132 includes the portion 134 to be fixed to the fixing portion 153 of the cleaning container 15. The bent portion 133 is arranged between the end portion 131 and another end portion 132. The bent portion 133 is arranged outward, with respect to the line segment connecting the contact portion 138 where the blade 14 contacts the photosensitive drum 1, with the portion 134 to be fixed, away from the surface of the photosensitive drum 1.

In the present exemplary embodiment, as a material for the supporting member 13, a SUS material was employed. The thickness t of the supporting member 13 was 0.2 mm. An angle θs of the bent portion 133 illustrated in FIG. 6 was uniformly set to 90 degrees in a rotational axis direction of the photosensitive drum 1. Where a length of the end portion 131 of the supporting member 13 is L1 and a length of the end portion 132 is L2, L1=12 mm and L2=12 mm. Similarly to a conventional cleaning member, a set angle between the photosensitive drum 1 and the cleaning member 12 was set to 30 degrees and the intrusion amount was set to 1.05 mm.

In such a state, the contact pressure of the cleaning member 12 on the photosensitive drum 1 was about 35 gf per cm in the rotational axis direction. For comparison, when a verification was conducted with an angle set to 20 degrees, the contact pressure was about 30 gf per cm in the rotational axis direction of the photosensitive drum 1.

The angle θ of the bent portion 133 is not necessary to be set to 90 degrees. The predetermined contract pressure can be obtained by adjusting the length L1 of the end portion 131 and the length L2 of the end portion 132 of the supporting member 13, the set angle, and the intrusion amount.

As a material for the blade member 14, an urethane rubber was used. The hardness of the material was JIS-A hardness 70 degrees. It is preferable that the blade 14 deforms only in a small amount, and the force applied to the end portion 131 for elastically deforming the end portion 132, is increased. To achieve this, as illustrated in FIG. 6, the shape of the blade member 14 was set in order to minimize the influence of the deformation of the blade 14 as much as possible. In this embodiment, k=3.0 mm, l=2.0 mm, m=0.5 mm, and n=0.5 mm.

As a comparative example 1, also the known cleaning member 612 was checked. FIG. 17 is a detailed schematic structural view illustrating the cleaning member 612. At a tip portion of the supporting member 613 which has hardness, the blade 614 is supported. By deformation of the blade 614 that is an elastic member, a cleaning contact pressure is generated. A material used for the blade 614 was an urethane rubber, and the hardness of the material was JIS-A hardness 70 degrees. In FIG. 18, a length of a free end of the blade 614 is L, and L was set to 5.2 mm. As a material for the supporting member 613, a SUS material was used. The thickness t was set to 1.8 mm. A set angle between the photosensitive drum 601 and the cleaning member 612 was 30 degrees and an amount of intrusion was 1.05 mm. In this example, the contact pressure of the cleaning member 612 on the photosensitive drum 601 was about 35 gf per cm in the rotation axis direction of the photosensitive drum 601.

These cleaning devices were subjected to deformation calculation, and a dynamic contact pressure was calculated. As the calculating method, a friction to be applied was considered and a relationship between a deformation shape and a force to be applied was calculated when the tip portion of the cleaning member is pushed by one rotation toward a downstream direction of the photosensitive drum 601. Further, from the obtained forces, a component perpendicular to the surface of the photosensitive drum 601 was taken as the contact pressure, and a component parallel to the surface of the photosensitive drum was taken as a friction force. Then, the ratio between the contact pressure and the friction force was obtained as a friction coefficient.

When performing this deformation calculation, in consideration of the blade supporting member and neutral axes of the blade, a simple two-dimensional cantilever beam (assumption of Bernoulli-Euler) was used as a model for the calculation. As parameters in the calculation, a longitudinal bending modulus E of the SUS plate of 167,000 MPa, and a longitudinal bending modulus E of the urethane rubber of 6 MPa were used.

Figure 7A:
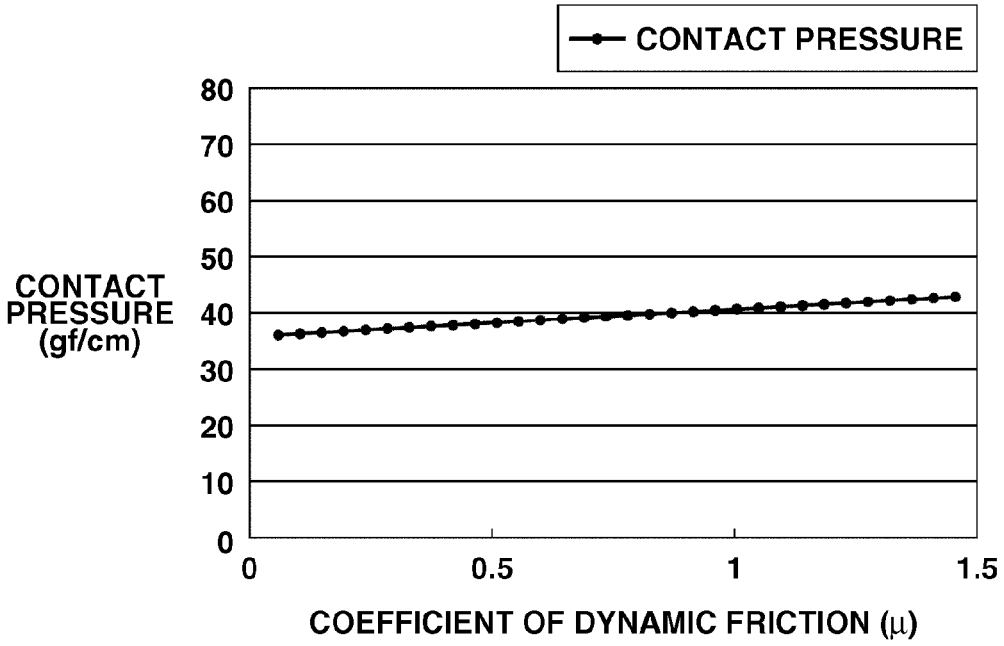
FIGS. 7A and 7B illustrate results of each simulation calculation of a relationship between a coefficient of dynamic friction and a contact pressure.
Figure 7B:
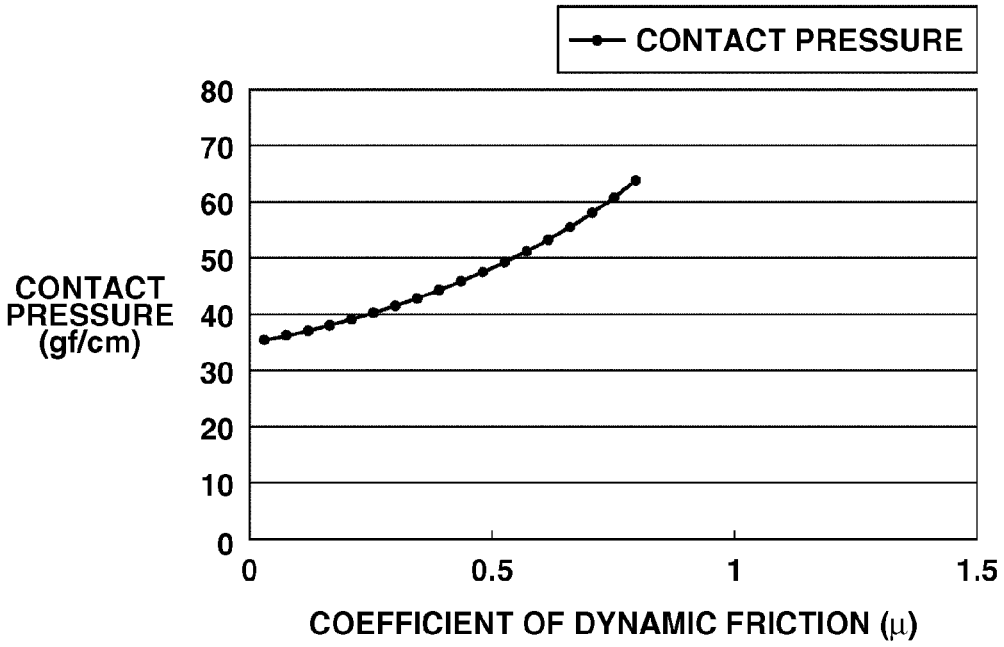

FIGS. 7A and 7B show the results. In these Figures, the horizontal axis shows a coefficient of dynamic friction, and the vertical axis shows a contact pressure. FIG. 7A illustrates the results of the present exemplary embodiment, and FIG. 7B illustrates the results of the comparative example 1. As compared to the comparative example 1, it can be seen that a change in a contact pressure with respect to a coefficient of dynamic friction is very small in the present exemplary embodiment.

Figure 8A:
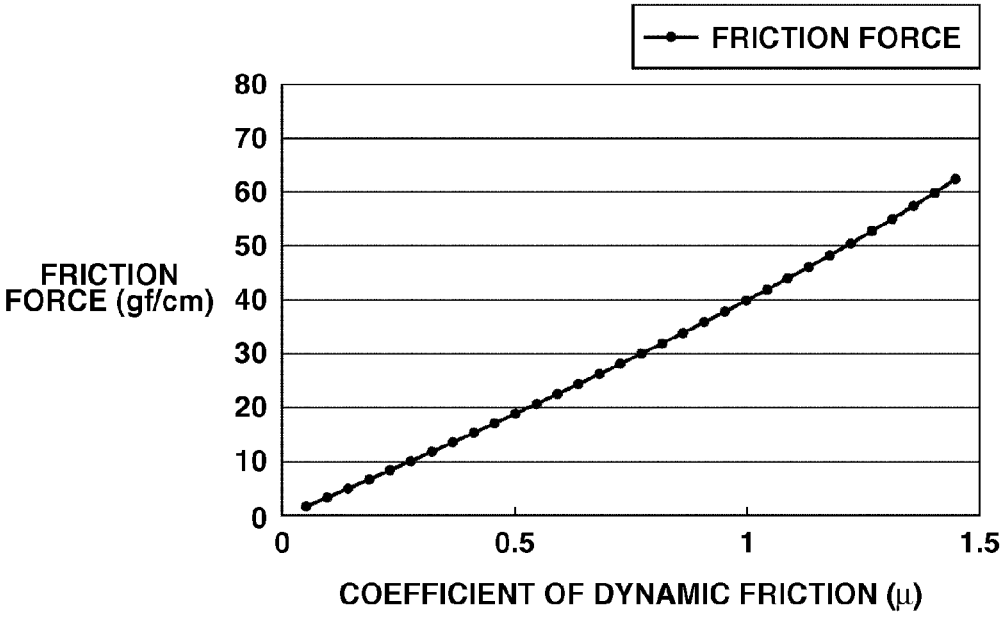
FIGS. 8A and 8B illustrate results of each simulation calculation of a relationship between a coefficient of dynamic friction and a friction force.
Figure 8B:
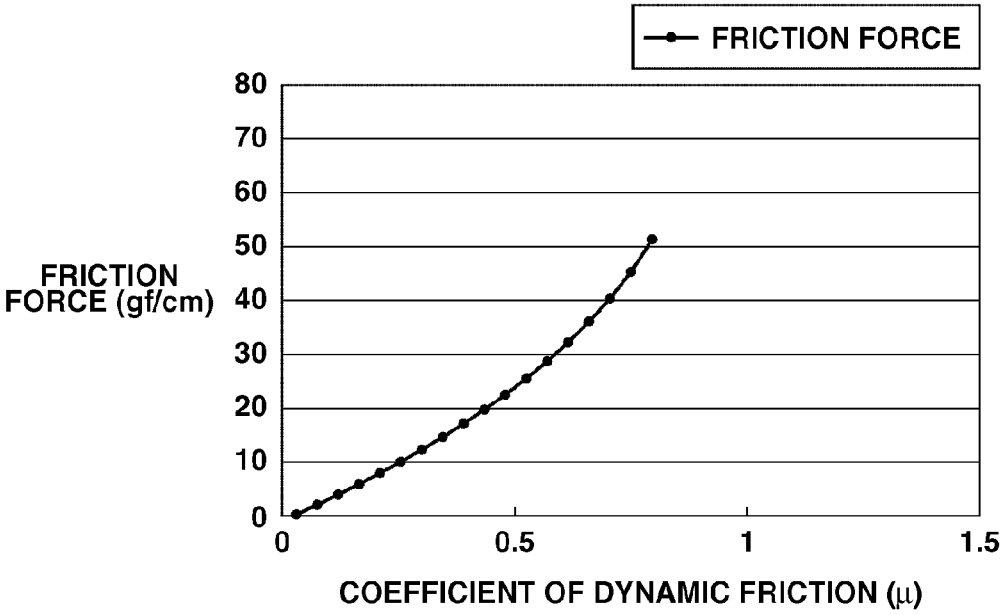

FIGS. 8A and 8B illustrate relationships between a coefficient of dynamic friction and a friction force. In these Figures, the horizontal axis indicates a coefficient of dynamic friction, and the vertical axis indicates a friction force. FIG. 8A illustrates the results of the exemplary embodiment, and FIG. 8B illustrates the results of the comparative example 1. As compared to the comparative example 1, it can be seen that a change in a friction force with respect to a coefficient of dynamic friction is smaller in the present exemplary embodiment. In the comparative example 1, a friction force increases at an accelerated pace with an increase in a coefficient of dynamic friction. On the other hand, in the present exemplary embodiment, a friction force increases substantially linearly with an increase in a coefficient of dynamic friction. In the above-described modeling calculation, we confirmed that the structure of the cleaning member 12 according to the exemplary embodiment stabilized the contact pressure as compared to the conventional structure.

Figure 13:
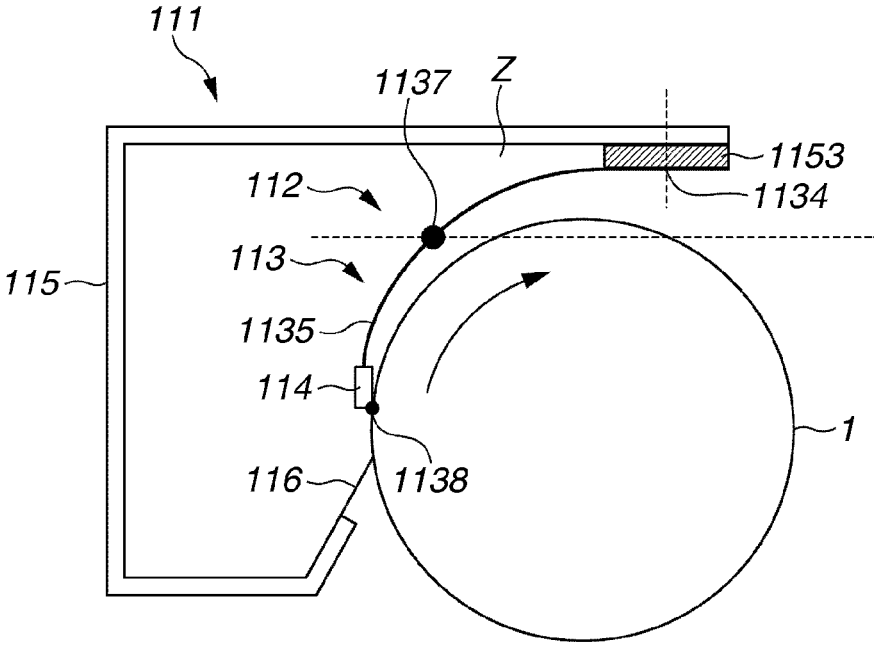
FIG. 13 is a schematic structural view illustrating a cleaning device according to the exemplary embodiment.

As another structure according to the exemplary embodiment, FIG. 13 illustrates a schematic structural view of a cleaning device 111.

The cleaning device 111 includes a cleaning member 112, a scooping sheet 116, and a cleaning container 115. The cleaning member 112 contacts the surface of the photosensitive drum 1 to scrape off the residual toner remaining on the photosensitive drum 1 after the transfer. The scooping sheet 116 is provided at the upstream side in the rotation direction of the photosensitive drum 1 to scoop the scraped toner, and contacts the surface of the photosensitive drum 1. The cleaning container 115 stores the scooped residual toner.

A supporting member 113 supports a blade 114, and the supporting member 113 is a flexible curved member. The supporting member 113 includes a blade portion supporting portion 1135 having the blade 114 at the tip portion side, a portion 1134 to be fixed to a fixing portion 1153, and a curving peak 1137 arranged between the blade portion supporting portion 1135 and the portion 1134 to be fixed. The curving peak 1137 is positioned outward, with respect to the line segment connecting a contact portion 1138 where the blade portion 114 contacts the photosensitive drum 1, with the portion 1134 to be fixed, away from the surface of the photosensitive drum 1.

The portion 1134 to be fixed, of the supporting member 113 is disposed, with respect to the contact portion 1138, at the downstream side in the movement direction of the photosensitive drum 1.

The portion from the curving peak 1137 to the portion 1134 to be fixed, of the flexible and curved supporting member 113 is arranged to face the inner wall of the cleaning container 115. As described above, when the photosensitive drum 1 is attached, or the photosensitive drum 1 is rotated, the supporting member 113 largely deforms. At this time, if the portion from the curving peak 1137 to the portion 1134 to be fixed interferes with the inner wall of the cleaning container 115, the effects of the exemplary embodiment of the present invention are not obtained. To solve the problem, as illustrated in FIG. 13, between the portion from the curving peak 1137 to the portion 1134 to be fixed, and the inner wall of the cleaning container 115, a space Z is provided. The space Z is set to a distance of a deformation amount or more to allow the elastic deformation in the portion from the curving peak 1137 to the portion 1134 to be fixed. Also in this structure, the cleaning device 111 can be downsized, especially, the thickness can be reduced. Further, the storage area for storing the residual toner can be increased.

Hereinafter, with reference to FIG. 9, the first exemplary embodiment of the present invention will be described.

Figure 9:
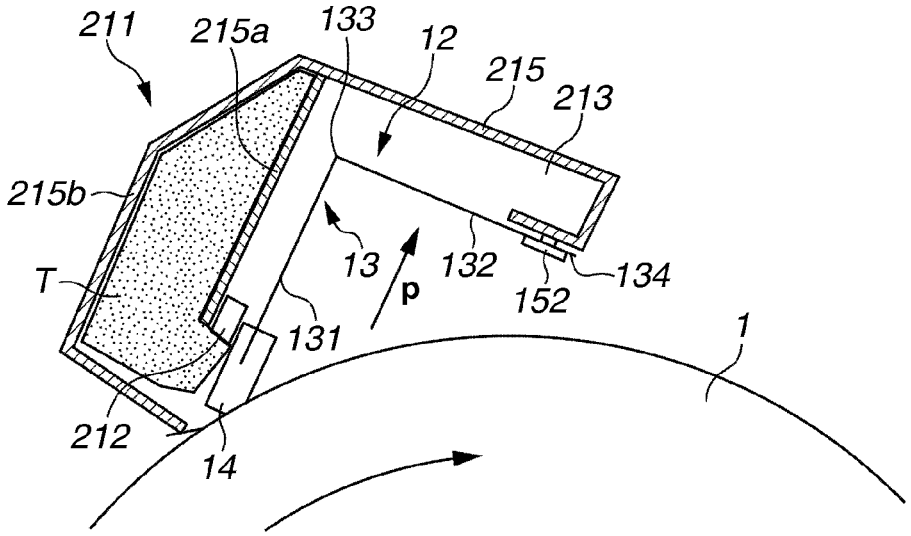
FIG. 9 is a schematic structural view illustrating a cleaning device according to the first exemplary embodiment.

FIG. 9 illustrates a cleaning device 211 used in the exemplary embodiment. In the present exemplary embodiment, the above-described cleaning member 12 is used, and in a cleaning container 215, a partition portion (sealing member attachment portion) 215*a* protrudes. The partition portion 215*a* extends obliquely downward from an upper surface portion 215*d* that is a ceiling of the cleaning container 215. The partition portion 215*a* extends in the axis direction of the drum 1, and as illustrated in FIG. 9, the partition portion 215*a* forms a space for containing a toner T together with an outer wall 215*b* of the cleaning container 215. On the partition portion 215*a*, an elastic sealing portion 212 is provided that contacts the blade 14. The elastic sealing portion 212 inhibits intrusion of waste toner into a space 213 in an upper portion of the end portion 132 of the supporting member 13. This structure provides the area allowing the end portion 132 of the supporting member 13 to deform in the arrow direction p when friction between the drum 1 and the blade 14 increases without intruding into the space 213. Further, as in the first exemplary embodiment, even if the portion 134 to be fixed is positioned lower than the bent portion 133 in the vertical direction, the sealing portion 212 prevents the toner from intruding into the space 213. Further, even in a case where a unit detachable from the image forming apparatus body M is used as the cleaning device 211, irrespective of orientation of the cleaning device 211, the intrusion of the toner into the space 213 can be prevented.

As described above, the friction between the drum 1 and the blade 14 of the cleaning member 12 allows the end portion 132 of the supporting member 13 to deform, and thereby increase in the contact pressure of the blade 14 can be suppressed. Further, when a user changes an orientation of the cleaning device 211 and attaches the device to the image forming apparatus body M, intrusion of waste tone into the space 213 can be prevented, and thereby movement of the cleaning member 12 is not prevented.

Figure 10:
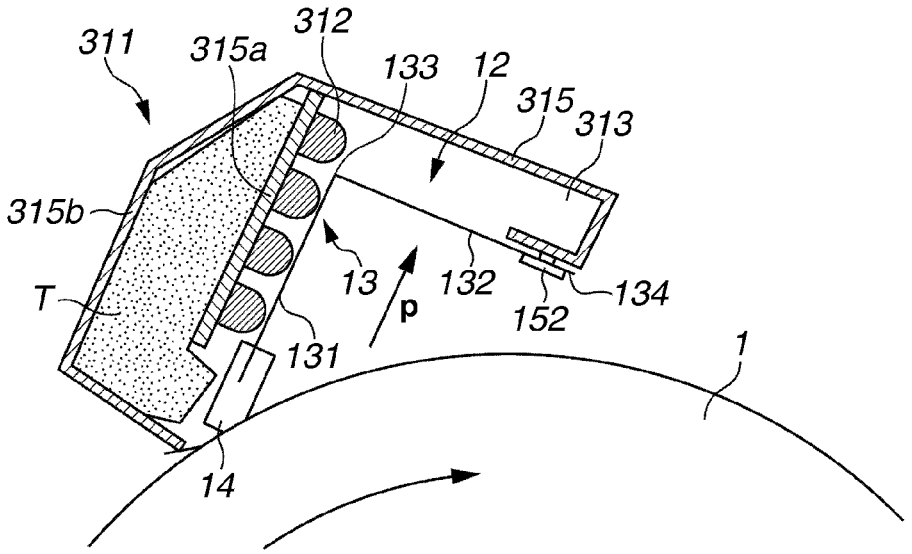
FIG. 10 is a schematic structural view illustrating a cleaning device according to the second exemplary embodiment.

Hereinafter, with reference to FIG. 10, the second exemplary embodiment of the present invention will be described.

In the first exemplary embodiment, on the partition portion 215*a*, the sealing portion 212 that contacts the blade 14 is provided. In the second exemplary embodiment, as illustrated in FIG. 10, on a partition portion 315*a*, an elastic sealing member 312 having a labyrinth shape is provided. The elastic sealing member 312 contacts the end portion 131 of the supporting member 13. The other structures are similar to those in the first exemplary embodiment. Also in this structure, the friction between the drum 1 and the blade 14 of the cleaning member 12 allows the end portion 132 of the supporting member 13 to deform, and thereby increase in the contact pressure of the blade 14 can be suppressed. Further, even when a user changes an orientation of a cleaning device 311 and attaches the device to the image forming apparatus body M, intrusion of waste tone into a space 313 can be prevented, and thereby movement of the cleaning member 12 is not inhibited.

Figure 11:
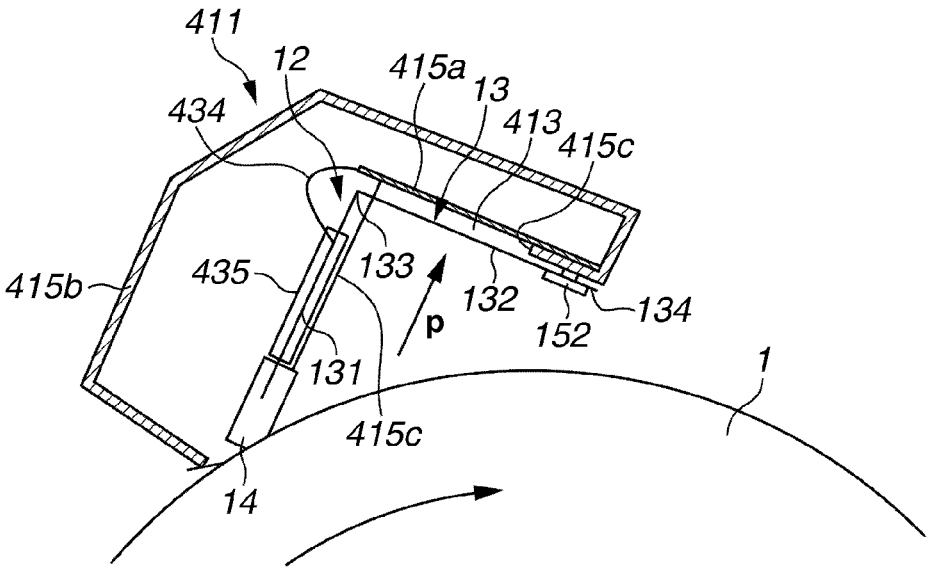
FIG. 11 is a schematic structural view illustrating a cleaning device according to the third exemplary embodiment.

With reference to FIG. 11, the third exemplary embodiment of the present invention will be described. FIG. 11 illustrates a cleaning device 411 used in the third exemplary embodiment. In the present exemplary embodiment, the above-described cleaning member 12 is used. The cleaning member 12 is fixed, in the portion 134 to be fixed, of the supporting member 13, to a fixing portion 415*c* provided in a cleaning container 415. In the cleaning container 415, at an upper portion of the fixing portion 415*c*, a partition portion 415*a* extends obliquely upward. In the partition portion 415*a*, a fabric member 434 that is a flexible sealing member is provided. The fabric member 434 prevents intrusion of waste toner into a space 413 between the partition portion 415*a* and the end portion 132 of the supporting member 13. The fabric member 434 is connected to the end portion 131 of the supporting member 13. At one end side of the cleaning device 411 in the longitudinal direction, as illustrated in FIG. 11, between a side wall 415*c* of the cleaning container 415 and the end portion 131 of the supporting member 13, an end portion sealing member 435 is provided. The end portion sealing member 435 is provided to prevent the toner from leaking in the longitudinal direction of the cleaning device 411 to the outside of the cleaning device 411. Although not illustrated in FIG. 11, to the other end side of the cleaning device 411 in the longitudinal direction, a similar end portion sealing member is provided.

The above-described structure provides, without intruding into the space 413, the area allowing the end portion 132 of the supporting member 13 to deform in the arrow direction p when friction between the drum 1 and the blade 14 increases. Further, similarly to the first exemplary embodiment, even if the portion 434 to be fixed is positioned lower than a bent portion 433 in the vertical direction, the sealing portion 434 prevents the toner from intruding into the space 413. Further, even in a case where a unit detachable from the image forming apparatus body M is used as the cleaning device 411, irrespective of orientation of the cleaning device 211, the intrusion of the toner into the space 213 can be prevented. In the present exemplary embodiment, also at the upper portion of the partition portion 415*a*, waste toner can be stored, and consequently, as compared to the first and second exemplary embodiments, a wider space for storing the waste toner can be provided.

Figure 12:
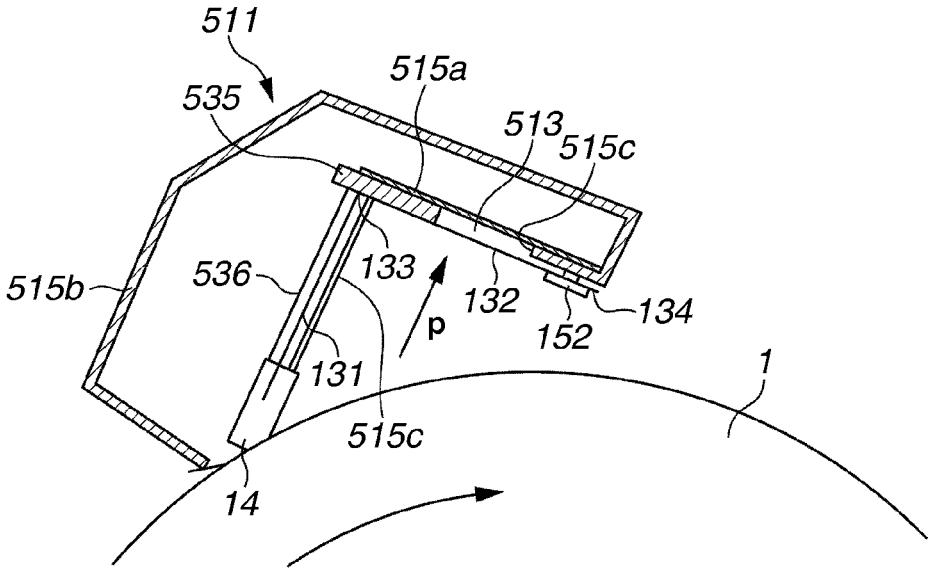
FIG. 12 is a schematic structural view illustrating a cleaning device according to the fourth exemplary embodiment.

FIG. 12 illustrates a fourth exemplary embodiment that is a modification of the third exemplary embodiment. In the present exemplary embodiment, differently from the above-described exemplary embodiment, in place of the fabric member 434 serving as the sealing member, a sealing member 535 of a foam material is provided in a space 513 between a partition portion 515*a* and the end portion 132 of the supporting member 13. As long as a size of the sealing member 535 does not largely affect the deformation of the end portion 132 of the supporting member 13, there is no problem in this structure. Also in the fourth exemplary embodiment, at one end side and another end side of a cleaning device 511 in the longitudinal direction, as illustrated in FIG. 12, between a side wall 515*c* of a cleaning container 515 and the end portion 131 of the supporting member 13, an end portion sealing member 535 is provided. The end portion sealing member 535 is provided to prevent the toner from leaking in the longitudinal direction of the cleaning device 511 to the outside of the cleaning device 511.

As described above, in the first to fourth exemplary embodiments, the cleaning member 12 provided with the supporting member 13 having the bent portion 133 between one end portion 131 and another end portion 132 has been used and described. Alternatively, the cleaning member 12 can be the above-described cleaning member 112 having the curved supporting member 113 in FIG. 13.

This structure provides a more stable contact pressure during driving of the image bearing member as compared to the known structure. In other words, increase in torque in driving the image bearing member and curling of the blade can be reduced.

Further, the waste toner removed from the photosensitive drum and stored in the cleaning container does not accumulate in the space between the cleaning container and the cleaning member when the cleaning device is attached or detached. This provides, without interfering with the movement of the cleaning member, more stable contact pressure during the driving of the photosensitive drum as compared to the known structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169833 filed Jul. 31, 2012, which is hereby incorporated by reference herein in its entirety.

What is claimed is:

1. A cleaning device used in an image forming apparatus, the cleaning device comprising:

a cleaning member configured to remove a developer from an image bearing member, the cleaning member being attached to a fixing portion provided in a frame, the cleaning member including a blade portion contacting the image bearing member in a counter direction with respect to a moving direction of the image bearing member, a flexible supporting member configured to support the blade portion including one end portion in which the blade portion is provided, the other end portion having a portion to be fixed to the fixing portion, and a bent portion arranged between the one end portion and the other end portion, the bent portion being arranged outward, with respect to the line segment connecting a contact portion where the blade contacts the image bearing member, with the portion to be fixed, away from the surface of the image bearing member, including the supporting member where the portion to be fixed, is arranged with respect to the contact portion, at the downstream side in the movement direction of the image bearing member, wherein the portion to be fixed is positioned lower than the bent portion in the vertical direction; and a container configured to store the developer removed from the image bearing member, the container being formed of the frame, wherein between the frame and the other end portion, a space allowing the other end portion to elastically deform is provided, and the container is provided with a sealing member configured to prevent intrusion of the developer into the space.

2. The cleaning device according to claim 1, wherein the sealing member is attached to a sealing member attachment portion provided in the container, and the sealing member contacts the end portion or the blade portion.

3. The cleaning device according to claim 1, wherein the sealing member is made of a foam material, and provided in the space.

4. A cleaning device used in an image forming apparatus, the cleaning device comprising:

a cleaning member configured to remove a developer from an image bearing member, the cleaning member being attached to a fixing portion provided in a frame, the cleaning member including a blade portion contacting the image bearing member in a counter direction with respect to a moving direction of the image bearing member, a flexible supporting member configured to support the blade portion, the flexible supporting member having a curved shape for supporting the blade portion, including a blade portion supporting portion in which the blade portion is provided at a tip side, a portion to be fixed to the fixing portion, and a curving peak arranged between the blade portion supporting portion and the portion to be fixed, the curving peak being arranged outward, with respect to the line segment connecting a contact portion where the blade portion contacts the image bearing member, with the portion to be fixed, away from the surface of the image bearing member, including the supporting member where the portion to be fixed, is arranged with respect to the contact portion, at the downstream side in the movement direction of the image bearing member; and a container configured to store the developer removed from the image bearing member, the container being formed of the frame, wherein between a portion from the curving peak to the portion to be fixed, and the frame, a space allowing the portion to elastically deform is provided, and the container is provided with a sealing member configured to prevent intrusion of the developer into the space, and wherein the portion to be fixed is positioned lower than the curving peak in the vertical direction.

5. The cleaning device according to claim 4, wherein the sealing member is attached to a sealing member attachment portion provided in the container, and the sealing member contacts the supporting member between the blade portion supporting portion and the curving peak.

6. The cleaning device according to claim 4, wherein the sealing member is attached to a sealing member attachment portion provided in the container, and the sealing member contacts the blade portion.

7. The cleaning device according to claim 4, wherein the sealing member is made of a foam material, and provided in the space.

8. An image forming apparatus configured to form an image on a recording medium, the image forming apparatus comprising:

(i) an image bearing member; and (ii) a cleaning device including a cleaning member configured to remove a developer from the image bearing member, the cleaning member being attached to a fixing portion provided in a frame, the cleaning member including a blade portion contacting the image bearing member in a counter direction with respect to a moving direction of the image bearing member, and a flexible supporting member configured to support the blade portion including one end portion in which the blade portion is provided, the other end portion having a portion to be fixed to the fixing portion, and a bent portion arranged between the one end portion and the other end portion, the bent portion being arranged outward, with respect to the line segment connecting a contact portion where the blade contacts the image bearing member, with the portion to be fixed, away from the surface of the image bearing member including the supporting member where the portion to be fixed, is arranged with respect to the contact portion, at the downstream side in the movement direction of the image bearing member, and a container configured to store the developer removed from the image bearing member, the container being formed of the frame, in which between the frame and the other end portion, a space allowing the other end portion to elastically deform is provided, and the container is provided with a sealing member configured to prevent intrusion of the developer into the space, wherein the portion to be fixed is positioned lower than the bent portion in the vertical direction.

9. The image forming apparatus according to claim 8, wherein the sealing member is attached to a sealing member attachment portion provided in the container, and the sealing member contacts the one end portion or the blade portion.

10. The image forming apparatus according to claim 8, wherein the sealing member is made of a foam material, and provided in the space.

11. An image forming apparatus configured to form an image on a recording medium, the image forming apparatus comprising:

(i) an image bearing member; and (ii) a cleaning device including a cleaning member configured to remove a developer from the image bearing member, the cleaning member being attached to a fixing portion provided in a frame, the cleaning member including a blade portion contacting the image bearing member in a counter direction with respect to a moving direction of the image bearing member, and a flexible supporting member configured to support the blade portion, the flexible supporting member having a curved shape for supporting the blade portion including a blade portion supporting portion in which the blade portion is provided at a tip side, a portion to be fixed to the fixing portion, and a curving peak arranged between the blade portion supporting portion and the portion to be fixed, the curving peak being arranged outward, with respect to the line segment connecting a contact portion where the blade contacts the image bearing member, with the portion to be fixed, away from the surface of the image bearing member, including the supporting member where the portion to be fixed, is arranged with respect to the contact portion, at the downstream side in the movement direction of the image bearing member, and a container configured to store the developer removed from the image bearing member, the container being formed of the frame, in which between the frame, and a portion from the curving peak to the portion to be fixed, a space allowing the portion to elastically deform is provided, and the container is provided with a sealing member configured to prevent intrusion of the developer into the space, wherein the portion to be fixed is positioned lower than the curving peak in the vertical direction.

12. The image forming apparatus according to claim 11, wherein the sealing member is attached to a sealing member attachment portion provided in the container, and the sealing member contacts the supporting member between the blade portion supporting portion and the curving peak.

13. The image forming apparatus according to claim 11, wherein the sealing member is attached to a sealing member attachment portion provided in the container, and the sealing member contacts the blade portion.

14. The image forming apparatus according to claim 11, wherein the sealing member is made of a foam material, and provided in the space.

15. A process cartridge detachably mountable to an apparatus body of an image forming apparatus, the process cartridge comprising:

(i) an image bearing member; and (ii) a cleaning device including a cleaning member configured to remove a developer from the image bearing member, the cleaning member being attached to a fixing portion provided in a frame, the cleaning member including a blade portion contacting the image bearing member in a counter direction with respect to a moving direction of the image bearing member, and a flexible supporting member configured to support the blade portion including one end portion in which the blade portion is provided, the other end portion having a portion to be fixed to the fixing portion, and a bent portion arranged between the one end portion and the other end portion, the bent portion being arranged outward, with respect to the line segment connecting a contact portion where the blade contacts the image bearing member, with the portion to be fixed, away from the surface of the image bearing member, including the supporting member where the portion to be fixed is arranged, with respect to the contact portion, at the downstream side in the movement direction of the image bearing member, and a container configured to store the developer removed from the image bearing member, the container being formed of the frame, in which between the frame and the other end portion, a space allowing the other end portion to elastically deform is provided, and the container is provided with a sealing member configured to prevent intrusion of the developer into the space, wherein the portion to be fixed is positioned lower than the bent portion in the vertical direction.

16. The process cartridge according to claim 15, wherein the sealing member is attached to a sealing member attachment portion provided in the container, and the sealing member contacts the end portion or the blade portion.

17. The process cartridge according to claim 15, wherein the sealing member is made of a foam material, and provided in the space.

18. A process cartridge detachably mountable to an apparatus body of an image forming apparatus, the process cartridge comprising:

(i) an image bearing member; and (ii) a cleaning device including a cleaning member configured to remove a developer from the image bearing member, the cleaning member being attached to a fixing portion provided in a frame, the cleaning member including a blade portion contacting the image bearing member in the counter direction with respect to a moving direction of the image bearing member, a flexible supporting member configured to support the blade portion, the flexible supporting member having a curved shape for supporting the blade portion, including a blade portion supporting portion in which the blade portion is provided at a tip side, a portion to be fixed to the fixing portion, and a curving peak arranged between the blade portion supporting portion and the portion to be fixed, the curving peak being arranged outward, with respect to the line segment connecting a contact portion where the blade portion contacts the image bearing member, with the portion to be fixed, away from the surface of the image bearing member, including the supporting member where the portion to be fixed, is arranged, with respect to the contact portion, at the downstream side in the movement direction of the image bearing member, and a container configured to store the developer removed from the image bearing member, the container being formed of the frame, in which between a portion from the curving peak to the portion to be fixed, and the frame, a space allowing the portion to elastically deform is provided, and the container is provided with a sealing member configured to prevent intrusion of the developer into the space wherein the portion to be fixed is positioned lower than the curving peak in the vertical direction.

19. The process cartridge according to claim 18, wherein the sealing member is attached to a sealing member attachment portion provided in the container, and the sealing member contacts the supporting member between the blade portion supporting portion and the curving peak.

20. The process cartridge according to claim 18, wherein the sealing member is attached to a sealing member attachment portion provided in the container, and the sealing member contacts the blade portion.

21. The process cartridge according to claim 18, wherein the sealing member is made of a foam material, and provided in the space.

22. A cleaning device used in an image forming apparatus, the cleaning device comprising:

a cleaning member configured to remove a developer from an image bearing member, the cleaning member being attached to a fixing portion provided in a frame, the cleaning member including (i) a blade portion contacting the image bearing member in a counter direction with respect to a moving direction of the image bearing member, (ii) a flexible supporting member configured to support the blade portion including one end portion in which the blade portion is provided, the other end portion having a portion to be fixed to the fixing portion, and (iii) a bent portion arranged between the one end portion and the other end portion; and a container configured to store the developer removed from the image bearing member, the container being formed of the frame, wherein between the frame and the flexible supporting member, a space allowing the flexible supporting member to elastically deform is provided, and the container is provided with a sealing member configured to prevent intrusion of the developer into the space, and wherein the portion to be fixed is positioned lower than the bent portion in the vertical direction.

23. The cleaning device according to claim 22, wherein the portion to be fixed is arranged with respect to the contact portion at the downstream side in the movement direction of the image bearing member.

24. The cleaning device according to claim 22, wherein the bent portion is arranged with respect to the contact portion at the downstream side in the movement direction of the image bearing member.

25. The cleaning device according to claim 22, wherein the bent portion is arranged with respect to the portion to be fixed at the upstream side in the movement direction of the image bearing member.

* * * * *